US011742588B2

(12) United States Patent
Iluz et al.

(10) Patent No.: US 11,742,588 B2
(45) Date of Patent: Aug. 29, 2023

(54) SYSTEM AND METHOD FOR FEEDING A PATCH ANTENNA ARRAY

(71) Applicant: WISENSE TECHNOLOGIES LTD., Tel Aviv (IL)

(72) Inventors: Zeev Iluz, Gan-Yavne (IL); Moshik Moshe Cohen, Neve Savion (IL)

(73) Assignee: WISENSE TECHNOLOGIES LTD., Tel Aviv (IL)

( * ) Notice: Subject to any disclaimer, the term of this patent is extended or adjusted under 35 U.S.C. 154(b) by 0 days.

(21) Appl. No.: 16/274,252

(22) Filed: Feb. 13, 2019

(65) Prior Publication Data

US 2020/0259268 A1 Aug. 13, 2020

(51) Int. Cl.

| | |
|---|---|
| ***H01Q 1/38*** | (2006.01) |
| ***H01Q 21/00*** | (2006.01) |
| ***H01Q 21/06*** | (2006.01) |

(52) U.S. Cl.

CPC ..... *H01Q 21/0037* (2013.01); *H01Q 21/065* (2013.01)

(58) Field of Classification Search

CPC combination set(s) only.

See application file for complete search history.

(56) References Cited

U.S. PATENT DOCUMENTS

| | | | | |
|---|---|---|---|---|
| 5,455,594 | A * | 10/1995 | Biasing | H01Q 1/364 343/700 MS |
| 6,154,176 | A * | 11/2000 | Fathy | H01Q 9/0414 343/846 |
| 2008/0136597 | A1* | 6/2008 | Choi | G06K 19/07749 340/10.1 |
| 2010/0238081 | A1* | 9/2010 | Achour | H01Q 9/0407 343/753 |
| 2015/0318618 | A1* | 11/2015 | Chen | H01P 7/082 343/750 |
| 2017/0187121 | A1* | 6/2017 | Kirino | H01Q 21/005 |
| 2017/0194716 | A1* | 7/2017 | Kirino | H01P 3/026 |
| 2018/0205134 | A1* | 7/2018 | Khan | H01Q 5/314 |
| 2018/0337456 | A1* | 11/2018 | Liu | H01Q 1/2283 |

OTHER PUBLICATIONS

Wincza et al., "Microstrip Antenna Arrays Fed by a Series-Parallel Slot-Coupled Feeding Network", IEEE Antennas and Wireless Propagation Letters, vol. 10, 2011, pp. 991-994.

Wincza et al., "Wide-Beam Microstrip Antenna for Application in 24 GHz Short-Range Doppler Sensors", Proceedings of ISAP 2014, Kaohsiung, Taiwan, Dec. 2-5, 2014, pp. 543-544.

* cited by examiner

*Primary Examiner* — Minh D A

(74) *Attorney, Agent, or Firm* — Pearl Cohen Zedek Latzer Baratz LLP

(57) ABSTRACT

An apparatus for feeding an antenna array may include a first layer including one or more antennas; a second layer adapted to convey an electromagnetic wave; and an aperture in a wall of the second layer enabling the electromagnetic wave to reach the first layer.

20 Claims, 5 Drawing Sheets

SYSTEM AND METHOD FOR FEEDING A PATCH ANTENNA ARRAY

FIELD OF THE INVENTION

The present invention relates generally antennas. More specifically, the present invention relates to operating antennas in patch antenna arrays.

BACKGROUND OF THE INVENTION

Patch antenna arrays are known in the art. Generally, a patch antenna array includes a set of flat metal surfaces (antennas) that, when excited, emit radio waves. More generally, patch antennas are used to convert propagating electromagnetic waves into alternating current or vice versa. Typically, feeding, the causing of antennas in a patch antenna array to radiate by supplying to the antennas the appropriate electric signals, is done using a microstrip, an electrical transmission line used to convey microwave-frequency signals or using a stripline, a transverse electromagnetic (TEM) transmission line, or using a substrate integrated waveguide (SIW). Systems and methods for converting electromagnetic waves into alternating current are also known. Series feeding is a technique that includes feeding an array of antennas from one of its ends or edges. However, this technique suffers from drawbacks. For example, the array's main lobe peak may be shifted from boresight vs. the frequency, where this tilt is caused by the accumulative phase error between the radiating elements. Additionally, when series feeding is used, antenna matching bandwidth is decreased as the number of radiating elements (antennas) is increased.

Some known methods reduce the lobe shift by feeding an antenna array from the center of the array (instead of feeding it from one of its edges) thus reducing the phase error. However, a disadvantage of known systems, methods and techniques that use center feeding is the usage of space of a surface that includes the antennas, for routing (placement of) the feeding lines to the centers of the arrays on a surface.

SUMMARY OF THE INVENTION

An apparatus for feeding an antenna array may include a first layer including one or more patch antennas; a second layer adapted to convey an electromagnetic wave; and an aperture in a wall of the second layer enabling the electromagnetic wave to reach the first layer.

The first layer may include one or more antenna arrays and the second layer may include respective one or more apertures located such that they are aligned with the respective centers of the one or more antenna arrays. The electromagnetic wave may be transferred between the first layer and the second layer using a nonconductive waveguide.

The first layer may include one or more antenna arrays and one or more radio frequency (RF) chips that generate a signal for driving the one or more antenna arrays. The first layer may include one or more antenna arrays and at least one of the arrays may include a transmission line adapted to receive the electromagnetic wave and serially feed first and second antennas included in the at least one of the arrays.

The first layer may include one or more antenna arrays and at least one antenna included in one of the antenna arrays may include an element for receiving the electromagnetic wave. The first layer may include one or more antenna arrays and a substrate integrated waveguide (SIW), the SIW may be adapted to receive the electromagnetic wave and serially feed a set of antennas included in the one or more antenna arrays.

The first layer may include at least one patch antenna array, the patch antenna array may include an element an adapted to: receive the electromagnetic wave; and serially feed patch antennas included in the array, from the center of the array toward its edges. The second layer may be shielded. The second layer may be a substrate integrated waveguide (SIW).

BRIEF DESCRIPTION OF THE DRAWINGS

Non-limiting examples of embodiments of the disclosure are described below with reference to figures attached hereto that are listed following this paragraph. Identical features that appear in more than one figure are generally labeled with a same label in all the figures in which they appear. A label labeling an icon representing a given feature of an embodiment of the disclosure in a figure may be used to reference the given feature. Dimensions of features shown in the figures are chosen for convenience and clarity of presentation and are not necessarily shown to scale. For example, the dimensions of some of the elements may be exaggerated relative to other elements for clarity, or several physical components may be included in one functional block or element. Further, where considered appropriate, reference numerals may be repeated among the figures to indicate corresponding or analogous elements.

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanied drawings. Embodiments of the invention are illustrated by way of example and not limitation in the figures of the accompanying drawings, in which like reference numerals indicate corresponding, analogous or similar elements, and in which:

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, and components, modules, units and/or circuits have not been described in detail so as not to obscure the invention. Some features or elements described with respect to one embodiment may be combined with features or elements described with respect to other embodiments. For the sake of clarity, discussion of same or similar features or elements may not be repeated.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. The term set when used herein may include one or more items.

Figure 1A:
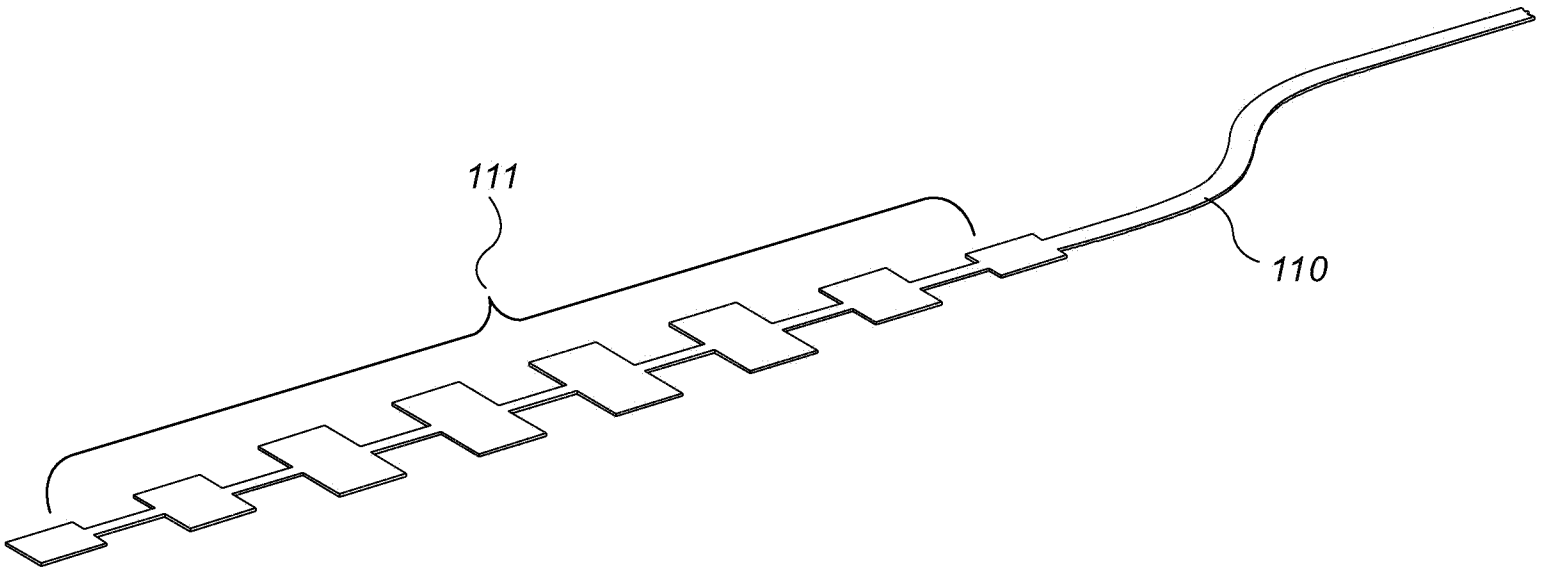
Fig. 1A PRIOR ART
FIG. 1A shows components of a prior art system.

Reference is made to FIG. 1A, which shows a prior art system. As shown, in prior art systems, an antenna patch array 111 is operated, or caused to radiate, using a conductive element 110 (e.g., a stripline or microstrip) that is used to convey, or apply, electromagnetic energy (e.g., in the form of alternating current/voltage) to the antenna patch array. For example, conductive element 110 may be connected to a generator or chip, e.g., a low noise amplifier (LNA) chip that may generate alternating current or voltage that causes antennas in patch array 111 to radiate (emit (energy in the form of rays or waves).

Embodiments of the invention may enable feeding patch antenna arrays via, or from, the centers of the arrays while avoiding using space on the surface that includes the antennas.

Figure 1B:
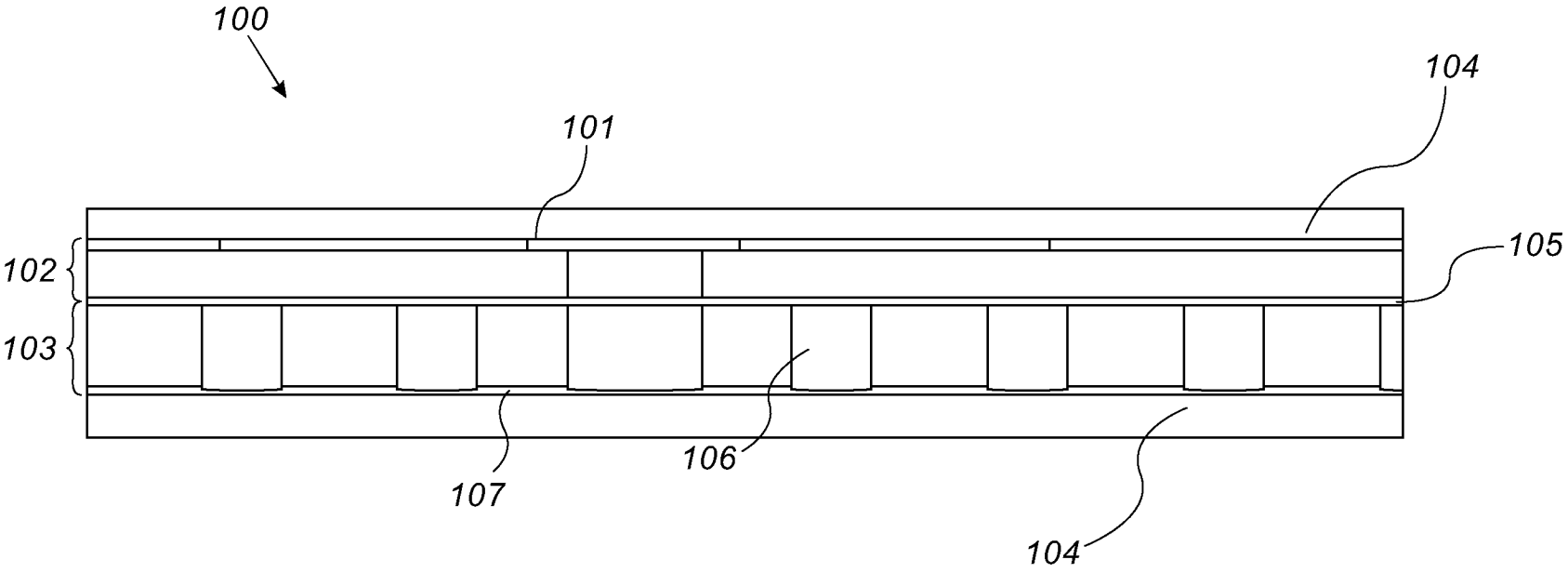
FIG. 1B shows components of an apparatus according to illustrative embodiments of the present invention.

Reference is made to FIG. 1B, which shows a cross section, side view, of components of an apparatus, assembly or system 100 according to some embodiments of the present invention. As shown, apparatus 100 may include a first layer (part or portion) 102 that includes a patch antenna array 101. As shown, assembly 100 may include a second layer (part or portion) 103 adapted to convey an electromagnetic wave.

Regions or spaces 104 may be any suitable medium, e.g., air or any other substance surrounding system 100. Element 105 may be a conductive (e.g., copper) wall, plane or surface providing electrical ground, element 106 may be a via that connects surfaces or walls 105 and 107, surface or wall 107 may be a conductive (e.g., copper) plane or surface providing electrical ground. Regions or spaces between and/or around elements of apparatus, assembly or system 100 may be filled with any printed circuit board (PCB) material or substrate, e.g., fiberglass. For example, the space between patch antenna array 101 and plane or wall 105 may be filled with fiberglass.

Figure 2:
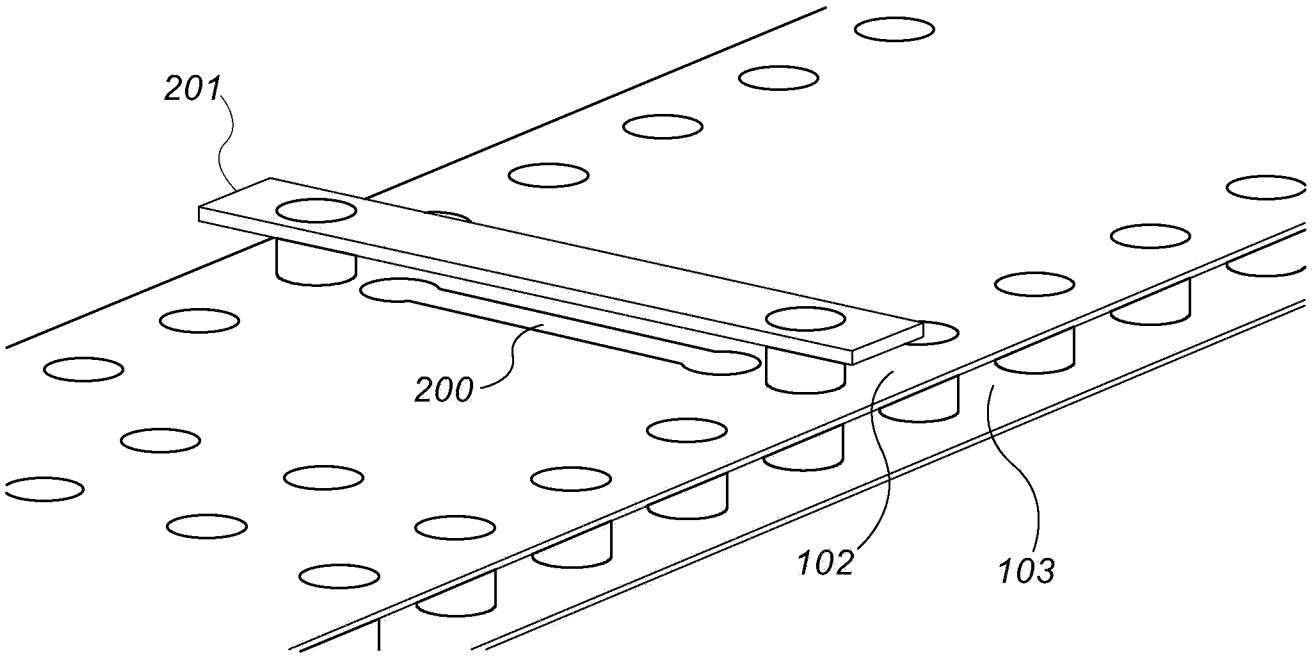
FIG. 2 shows components of an apparatus according to illustrative embodiments of the present invention.

Reference is additionally made to FIG. 2, which shows components of apparatus 100 according to some embodiments of the present invention.

As shown by FIG. 2, an aperture or opening 200 in a wall 105 of the second layer 103 may enable an electromagnetic wave guided by layer 103 to reach a coupling element 201 that may be included in, part of, or operatively connected to, patch antenna array 101. For example, coupling element 201 may be, or may be part of, a transmission line adapted to receive the electromagnetic wave from layer 103 and serially and symmetrically feed antennas included in patch antenna array 101. For clarity, the lines extending from coupling element 201 and the antennas fed by coupling element 201 are not shown in FIG. 2; they are shown in FIG. 3. Aperture 200 may have any shape and/or size, for example, aperture 200 may be round or square. In some embodiments, aperture 200 may be the exact size of coupling element 201 such that loss of energy is minimal, that is, coupling element 201 may completely cover aperture 200 thus any energy, in the form of electromagnetic wave, exiting aperture 200 hits (or is captured by) coupling element 201.

Figure 3A:
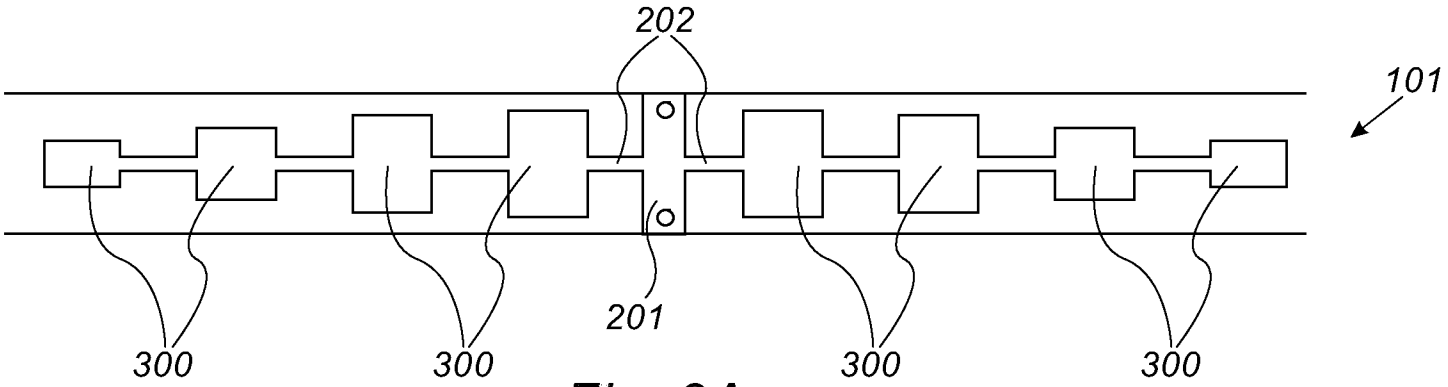
FIG. 3A shows components of an apparatus according to illustrative embodiments of the present invention.

Reference is additionally made to FIG. 3A which shows components of apparatus 100 according to some embodiments of the present invention. FIG. 3A shows a top view of patch antenna array 101 that includes patch antennas 300 and coupling element 201. Patch antennas 300 in an array 101 may be collectively referred to hereinafter as patch antennas 300 or individually as a patch antenna 300, merely for simplicity purposes. As shown, coupling element 201 may include, or may be connected to transmission line 202. Transmission line 202 may be a conductive (e.g., copper) strip or line that receives the electromagnetic wave from coupling element 201 and serially feeds antennas 300 in array 101 from the center of the array outward.

In some embodiments, e.g., in products, cases or configurations where an even number of antennas 300 is included in patch antenna array 101 (e.g., 8 in the example shown in FIG. 3A), coupling element 201 may be placed or located between two antennas in patch antenna array 101 such that coupling element 201 is in the middle of the array thus providing serial and symmetric feeding from the center of array 101. As further described, coupling element 201 may be any element or component adapted to receive an electromagnetic wave and serially feed patch antennas included in an array 101 array, from the center of the array toward its edges.

Figure 3B:
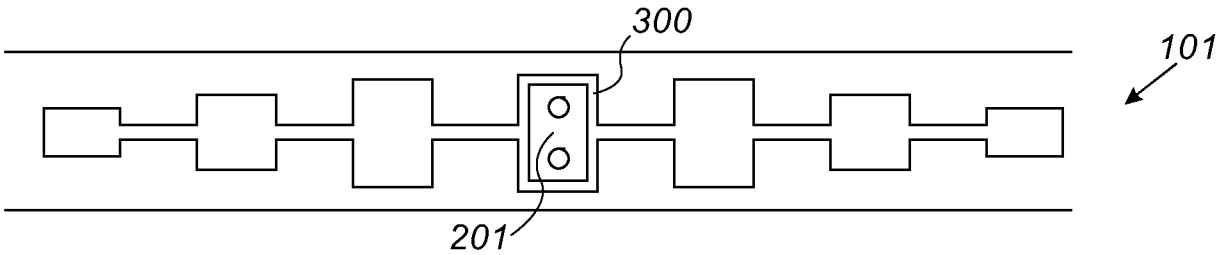
FIG. 3B shows components of an apparatus according to illustrative embodiments of the present invention.

Reference is additionally made to FIG. 3B which shows components of apparatus 100 according to some embodiments of the present invention. FIG. 3B shows a top view of patch antenna array 101 that includes antennas 300 and coupling element 201. In some embodiments, e.g., in cases or configurations where an odd number of antennas 300 is included in patch antenna array 101 (e.g., 7 in the example shown in FIG. 3B), coupling element 201 may be placed, included or embedded in one of the patch antennas in patch antenna array 101 such that coupling element 201 is in the middle or substantially in the middle of the array thus providing serial, symmetric feeding from the center of array 101.

In some embodiments, first layer 102 includes a plurality of patch antenna arrays 101. Specifically, feeding a patch antenna array according to embodiments of the invention, e.g., feeding a patch antenna array from below, and at its center, improves the fields of radar and antennas by enabling to place a large number of patch antenna arrays on a small surface, e.g., since the transmission component of an apparatus (e.g., layer 103 in apparatus 101) does not occupy space usable for placing antennas on the small surface.

Embodiments of the invention further improve the fields of radar and antennas as well as the technological fields of communication, imaging, radiography and sensing by enabling the feeding of each array in a plurality of patch antenna arrays, from its center or substantially from its center, even where the arrays are adjacently or closely placed on a surface. As described, center-feeding may improve performance of patch antenna arrays, e.g. by reducing the lobe shift and phase error.

For example, in some embodiments, a first layer (e.g., layer 102) includes a plurality of patch antenna arrays 101 and a second layer (e.g., layer 103 adapted to convey an electromagnetic wave) includes respective plurality of apertures (slots or openings) located such that they are aligned with the respective centers of the plurality of patch antenna arrays 101. For example, as shown and described with respect to aperture 200 and coupling element 201, each of a plurality of patch antenna arrays 101 may be placed such that its coupling element 201 is above (possibly covering) a respective aperture 200. Generally, the elements shown in FIGS. 4A and 4B may be duplicated in a system or apparatus such that the system or apparatus includes a plurality of patch antenna arrays 101 each fed by one of a plurality of apertures 200. Accordingly, each patch antenna array in a plurality of patch antenna arrays 101 can be centrally and serially fed, not from its side but, rather, from below thus the distance between first and second patch antenna arrays 101 can be reduced to a minimum.

The size and shape of aperture 200 may be set based on any parameter, aspect or consideration. For example, the size and/or shape of aperture 200 may be such that it is slightly smaller than the size of coupling element 201, e.g., such that aperture 200 is completely covered by coupling element 201 and loss is minimal.

Any other considerations may be taken into account when setting the size and shape of aperture 200. For example, the length of aperture 200 may be half the wavelength of the operating frequency for which apparatus 100 is designed. Of course, a plurality of systems 100 may be produced for different wavelengths with respective different apertures 200.

It is noted that using an aperture 200 and coupling element 201 to convey or transmit the electromagnetic wave from the bottom (second, e.g., layer 103) layer to the top (first, e.g., layer 102) and to thus feed antenna arrays 101 eliminates the need to use vias as done by prior art. Generally, and as known in the art, a via (e.g. vertical interconnect access) is an electrical connection between layers in a physical electronic circuit, for example a metal-coated silicon element used, for example, in SIW. However, vias cannot be used in, or for, systems or devices designed for millimeter wave (MM wave, mm-wave or millimeter band) frequencies or bands, e.g., the small size required may be too small for currently available or known via manufacturing systems to produce, accordingly, adequate vias for mm-wave ranges, bands or frequency are unavailable.

As described, a first layer (e.g., layer 102) may include one or more antenna arrays 101 and the arrays may each include a transmission line (e.g., transmission line 202) adapted to receive the electromagnetic wave and serially feed antennas included in the array. For example, as illustrated in FIG. 3A, when an even number of patch antennas 300 is included in array 101, coupling element 201 may be placed in the center of array 101 and use transmission lines 202 to centrally and serially feed antennas 300.

In some embodiments, e.g., when an odd number of antennas 300 is included in array 101, coupling element 201 may be placed, or included in, or be part of, one of antennas 300 in array 101, for example, as illustrated in FIG. 3B. Accordingly, an even or identical number of antennas 300 may be connected to coupling element 201 on each side thus true central feeding is achieved for any configuration and serial feeding is done from the center of an array 101 toward its edges or ends.

In some embodiments, a first or top layer (e.g., layer 102) may include one or more antenna arrays 101 as described and may further include a substrate integrated waveguide (SIW), for example, as shown in FIG. 2. A SIW included in layer 102 may be configured or adapted to receive electromagnetic waves from (a second, bottom) layer 103 and serially first antennas included in arrays 101. For example, coupling element 201 and transmission line 202 may be part of, or included in, a small SIW element in layer 102. Otherwise described, parts of layer 102 may be SIWs.

In some embodiments, the second (bottom or lower) layer may be shielded. For example, surface or wall 107 and/or medium 104 may shield layer 103 from the surrounding or apparatus 100 thus loss and interference are minimized. In some embodiments and as illustrated in FIGS. 1 and 2, the bottom layer, e.g., layer 103 may be, or may include, a SIW that, as described, includes apertures 200. Of course, a first layer in apparatus 100 may be shielded from a second layer. For example, other than aperture 200, layer 103 may be shielded from layer 102, e.g., by wall 105.

In many designs or cases, it is desirable to include the generator (e.g. circuit or chip) that causes antennas to radiate and the antennas on the same surface, or at the same height. However, placing the chip that drives the antennas and the antennas themselves on the same surface means current systems and methods need to allocate some of the space on the surface for running the lines that connect the driving chip with the antennas, on the other hand, it is desirable to keep the size of the surface as small as possible. As described, if center feeding is to be used, lines feeding the antenna arrays may need to be placed between antennas thus substantial space of the surface needs to be allocated.

Some embodiments of the invention enable placing a set of antenna arrays and a driving chip on the same surface and further center-feeding the set of antenna arrays without consuming or using space of the surface for conveying the signal from the driving chip to the antennas.

Figure 4A:
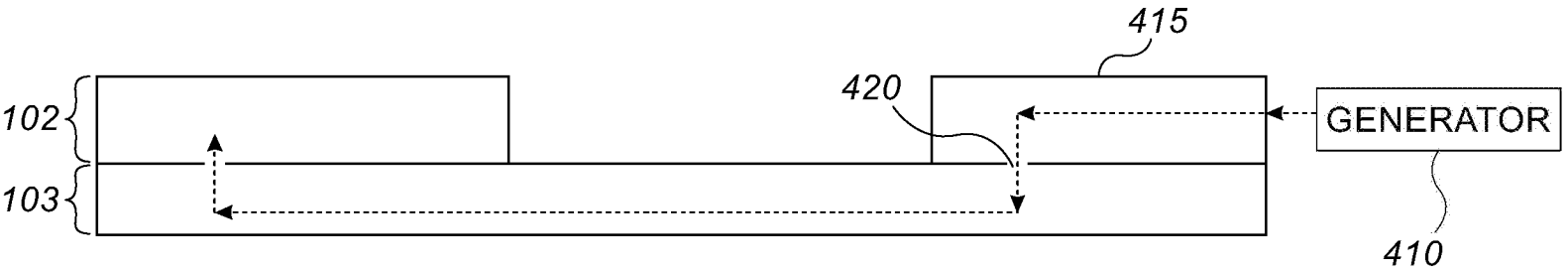
FIG. 4A shows components of an apparatus according to illustrative embodiments of the present invention.

Reference is made to FIG. 4A, which shows components of an apparatus, assembly or system according to some embodiments of the present invention. As shown, a generator 410 of an electrical signal may be placed on the same surface or height of layer 102, e.g., the outer most surface of an apparatus. Signal from circuit or chip 410 may be provided to a waveguide 415 that may be fabricated using nonconductive substance. For example, waveguide 415 may be an SIW as described. An aperture 420 that may be similar to aperture 200 may enable an electromagnetic wave induced in waveguide 415 to travel down to layer 103, the electromagnetic wave may then travel through layer 103 as described herein and may, through aperture 200, reach layer 102 where it may cause antennas 300 to radiate as described.

Accordingly, as illustrated by the dashed arrows in FIG. 4A, an electromagnetic wave may originate at the top layer, travel through a nonconductive waveguide 415, travel down to a bottom (or lower) layer 103 through an aperture 420, travel along the bottom or lower layer and up, through an aperture 200, from the bottom layer to the top layer 102 where it may excite antennas 300. It will be noted that the electromagnetic wave is transferred between the first layer and the second layer using a nonconductive wave-guiding methods, e.g., SIW.

Accordingly, embodiments of the invention enable the same (first) layer to include both a set of patch or other antenna arrays and one or more radio frequency (RF) chips, e.g., an LNA or PA chips that drive the antennas (e.g. supply signals to the antennas) where the signals from the driving chips to the antennas are conveyed in a lower (second) layer such that no space on the first layer is used for conveying the signal from the driving chips to the antennas. Using the inventive method of nonconductive waveguides and paths, embodiments or the invention enable transferring an electromagnetic wave between layers such that a route as shown in FIG. 4A is achieved. A route for an electromagnetic wave, traversing layers as shown in FIG. 4A and described herein, may be impractical (if not impossible) to realize using conductive items such as vias, striplines or microstrips. When used herein, upper and lower, top and bottom, and first and second are relative terms which may be used differently depending on the orientation of the device or viewer.

Figure 4B:
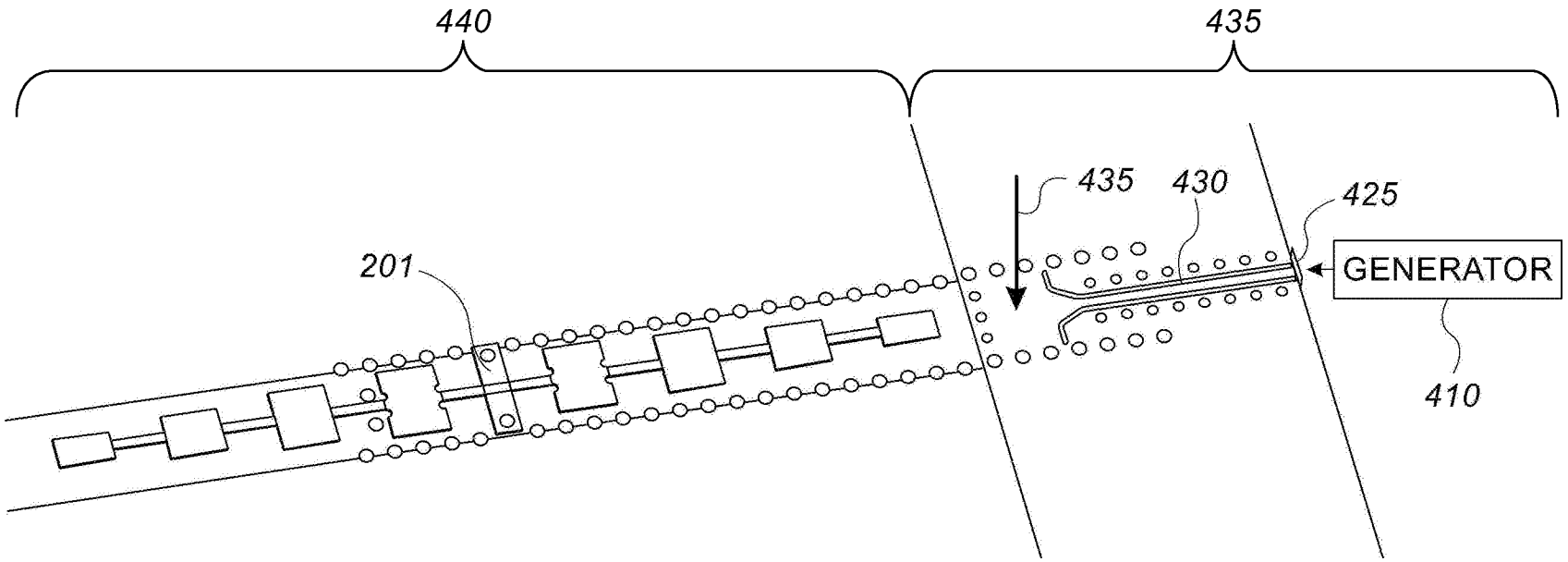
FIG. 4B shows components of an apparatus according to illustrative embodiments of the present invention.

Reference is additionally made to FIG. 4B which shows a top view of an apparatus according to some embodiments of the invention. As shown, generator 410 may cause a metal plate or antenna 425 to generate an electromagnetic wave that may travel through waveguide 430. As illustrated by arrow 435 pointing downward, an aperture 420 (not shown for simplicity) may enable the electromagnetic wave coming from generator 410 through waveguide 430 to travel down to layer 103 (not shown for simplicity), the electromagnetic wave may then travel along layer 103 as described and up, through aperture 200 to coupling element 201 as shown. Accordingly, and as described, embodiments of the invention enable guiding an electromagnetic wave from a first layer to a second layer without using metal or other conductive substance, e.g., using waveguides such as waveguides 430 and layer 103 and using apertures 200 and 420.

As described, a method of feeding antennas may include guiding an electromagnetic wave, by a waveguide in a first layer and through an aperture in a wall of the first layer, to a second layer including a patch antenna array. For example, an electromagnetic wave may be guided by a wave guide in layer 103 (first layer) and through aperture 200 in a wall (105) of the first layer to a second layer (102) that includes a patch antenna array (101).

In the description and claims of the present application, each of the verbs, "comprise" "include" and "have", and conjugates thereof, are used to indicate that the object or objects of the verb are not necessarily a complete listing of components, elements or parts of the subject or subjects of the verb. Unless otherwise stated, adjectives such as "substantially" and "about" modifying a condition or relationship characteristic of a feature or features of an embodiment of the disclosure, are understood to mean that the condition or characteristic is defined to within tolerances that are acceptable for operation of an embodiment as described. In addition, the word "or" is considered to be the inclusive "or" rather than the exclusive or, and indicates at least one of, or any combination of items it conjoins.

Descriptions of embodiments of the invention in the present application are provided by way of example and are not intended to limit the scope of the invention. The described embodiments comprise different features, not all of which are required in all embodiments. Some embodiments utilize only some of the features or possible combinations of the features. Variations of embodiments of the invention that are described, and embodiments comprising different combinations of features noted in the described embodiments, will occur to a person having ordinary skill in the art. The scope of the invention is limited only by the claims.

While certain features of the invention have been illustrated and described herein, many modifications, substitutions, changes, and equivalents may occur to those skilled in the art. It is, therefore, to be understood that the appended claims are intended to cover all such modifications and changes as fall within the true spirit of the invention.

Various embodiments have been presented. Each of these embodiments may of course include features from other embodiments presented, and embodiments not specifically described may include various features described herein.

The invention claimed is:

1. An apparatus comprising:

a first layer including a patch antenna array;

a coupling element operatively connected to the patch antenna array;

a second layer comprising a substrate integrated waveguide (SIW) adapted to convey an electromagnetic wave; and an aperture in a wall of the second layer enabling the electromagnetic wave conveyed by the second layer to reach the coupling element vertically, wherein the coupling element is adapted to feed the patch antenna array, and wherein the coupling element completely covers the aperture.

2. The apparatus of claim 1, wherein the second layer includes respective aperture located such that the respective one or more apertures are aligned with respective centers of the patch antenna array.

3. The apparatus of claim 1, wherein the electromagnetic wave is transferred between the first layer and the second layer using nonconductive waveguiding.

4. The apparatus of claim 1, wherein the first layer comprises a radio frequency (RF) chip that generates a signal for driving the patch antenna array.

5. The apparatus of claim 1, wherein the patch antenna array comprises a transmission line adapted to receive the electromagnetic wave and to serially feed first and second patch antennas included in the patch antenna array.

6. The apparatus of claim 1, wherein the patch antenna comprises an element for receiving the electromagnetic wave.

7. The apparatus of claim 1, wherein the first layer includes a substrate integrated waveguide (SIW), wherein the SIW is adapted to receive the electromagnetic wave and to serially feed first and second patch antennas included in the patch antenna array.

8. The apparatus of claim 1, wherein the patch antenna array includes an element adapted to:

receive the electromagnetic wave; and serially feed patch antennas included in the array, from the center of the array toward its edges.

9. The apparatus of claim 1, wherein the second layer is shielded.

10. The apparatus of claim 1, comprising:

a transmission line connected to the coupling element and adapted to receive the electromagnetic wave from the coupling element and to serially feed antennas in the patch antenna array.

11. The apparatus of claim 1, wherein the coupling element is in the size of the aperture.

12. The apparatus of claim 1, wherein the aperture is smaller than the coupling element.

13. The apparatus of claim 1, wherein the coupling element is located in the middle of the patch antenna array.

14. The apparatus of claim 1, wherein the coupling element is a transmission line.

15. A system comprising:

a first portion including a patch antenna array;

a second portion comprising a substrate integrated waveguide (SIW) adapted to convey an electromagnetic wave; and a coupling element operatively connected to the patch antenna array;

an aperture in a wall of the second portion enabling the electromagnetic wave conveyed by the second portion to reach the coupling element vertically, wherein the coupling element is adapted to feed the patch antenna array, and wherein the coupling element completely covers the aperture.

16. A method of feeding a patch antenna array, the method comprising guiding an electromagnetic wave, by a substrate integrated waveguide in a first layer and vertically through an aperture in a wall of the first layer, to a coupling element and from the coupling element to a second layer including the patch antenna array, wherein the coupling element completely covers the aperture.

17. The method of claim 16, wherein the aperture is located such that the aperture is aligned with a center of the patch antenna array.

18. The method of claim 16, wherein the electromagnetic wave is transferred between the first layer and the second layer using nonconductive waveguiding.

19. The method of claim 16, wherein the first layer comprises a radio frequency (RF) chip that generates a signal for driving the patch antenna array.

20. The method of claim 16, wherein the patch antenna array comprises a transmission line adapted to receive the electromagnetic wave and serially feed first and second patch antennas included in the patch antenna array.

* * * * *